US008221028B2

(12) United States Patent
Smith

(10) Patent No.: US 8,221,028 B2
(45) Date of Patent: Jul. 17, 2012

(54) BOAT LIFT OPERATED BY BOAT'S PROPULSIVE FORCE

(75) Inventor: J. Walter Smith, Seneca, SC (US)

(73) Assignee: Propulsion, Gas Turbine, and Energy Evaluations, LLC, Seneca, SC (US)

( * ) Notice: Subject to any disclaimer, the term of this patent is extended or adjusted under 35 U.S.C. 154(b) by 211 days.

(21) Appl. No.: 12/798,208

(22) Filed: Mar. 31, 2010

(65) Prior Publication Data

US 2011/0243663 A1 Oct. 6, 2011

(51) Int. Cl.
*B63C 3/06* (2006.01)

(52) U.S. Cl. ..... 405/3; 114/44; 114/45; 114/263

(58) Field of Classification Search ..... 405/1–4; 280/414.1–414.3; 114/44–46, 48, 263, 344
See application file for complete search history.

(56) References Cited

U.S. PATENT DOCUMENTS

| | | | | |
|---|---|---|---|---|
| 2,827,188 | A | 3/1958 | Reeder | |
| 3,127,041 | A | 3/1964 | Flynn et al. | |
| 4,037,421 | A | 7/1977 | Whitley, Jr. | |
| 4,050,595 | A * | 9/1977 | Bussard | 280/414.1 |
| 4,808,028 | A | 2/1989 | White | |
| 4,832,210 | A | 5/1989 | Wood, II | |
| 4,934,298 | A | 6/1990 | Pritchett | |
| 5,051,027 | A | 9/1991 | Horton | |
| 5,090,841 | A | 2/1992 | Penick, Jr. et al. | |
| 5,332,249 | A | 7/1994 | Solberg et al. | |
| 5,485,798 | A | 1/1996 | Samoian et al. | |
| 5,641,242 | A * | 6/1997 | Riviere | 405/3 |
| 5,755,529 | A | 5/1998 | Follett | |
| 5,860,379 | A | 1/1999 | Moody | |
| 6,006,687 | A | 12/1999 | Hillman et al. | |
| 6,602,022 | B1 * | 8/2003 | Wilkins | 405/3 |
| 6,955,135 | B1 * | 10/2005 | Wilkins | 114/263 |
| 7,210,420 | B1 * | 5/2007 | Basta | 114/44 |

OTHER PUBLICATIONS

International Search Report with Written Opinion, PCT/US2011/026381, Apr. 19, 2011.

* cited by examiner

*Primary Examiner* — Sunil Singh
(74) *Attorney, Agent, or Firm* — David M. Quinlan, P.C.

(57) ABSTRACT

A boat lift includes a lift frame rotatably mounted to a boat dock. A lower trolley with a buoyant body slides on the frame. An upper trolley slides on the frame and is engaged by the boat as it propels itself forward onto the frame when the latter is in a boat receiving position. A linkage connected between the trolleys causes the lower trolley and the buoyant body to slide rearwardly underneath the boat to rotate the lift frame into a final docking position in which the boat is out of the water. The upper trolley is locked into position, thus holding the lower trolley in position through the linkage. The boat is launched by releasing the upper trolley lock, which permits the upper trolley to slide rearwardly, with concomitant forward sliding movement of the lower trolley that permits the frame to rotate and launch the boat from the frame.

20 Claims, 9 Drawing Sheets

BOAT LIFT OPERATED BY BOAT'S PROPULSIVE FORCE

BACKGROUND OF THE INVENTION

1. Field of the Invention

The present invention relates to a boat lift, and more particularly, to a boat lift that uses the boat's propulsive force to lift the boat from the water.

2. Description of Related Art

Recreational boat owners can spend large amounts of time and money on maintenance and repair of their vessels. Leaving a boat or other craft in water for long periods can cause build up on the hull of algae (in fresh water) and barnacles (in salt water), and can cause pits and other surface imperfections in common hull materials like fiberglass and wood. Maintenance of a boat hull left in water can require significant expenditures of time and money. Rather than using labor-intensive and often costly approaches such as specially formulated paints or other surface treatments, many boat owners elect to keep their boats out of the water when not using them.

There are many types of boat lifts suitable for removing boats from the water. One example uses a structure that is first positioned beneath the hull of the boat and then lifted by cables. This type typically employs an electric motor to supply the necessary lifting force, but it can be operated manually as well. A variation uses a screw drive rather than cables. Another lifts a boat-supporting structure using buoyancy forces exerted upon the structure by large tanks or inflatable bladders filled with air by electric pumps. Other known devices use hydraulic actuators to drive mechanical links or cables to lift the boat. Another type of boat lift uses a buoyant structure that serves as the boat's dock, and the boat powers itself up and onto this buoyant structure. This type device is most useful with small "personal water craft," because it is more difficult to launch larger boats from this type of docking device.

The following patents illustrate a number of boat lifts that incorporate some of the above approaches:

U.S. Pat. No. 4,037,421 U.S. Pat. No. 5,090,841
U.S. Pat. No. 4,808,028 U.S. Pat. No. 5,485,798
U.S. Pat. No. 4,832,210 U.S. Pat. No. 5,860,379
U.S. Pat. No. 4,934,298 U.S. Pat. No. 6,006,687
U.S. Pat. No. 5,051,027

Boat lifts that operate manually are burdensome and slow, and all boat owners may not be capable of using them. On the other hand, electrically or hydraulically operated lifts require the ready availability of electrical power or pressurized fluid at the boat dock. In addition, they typically operate slowly, and can take undue time for both docking and launching the boat. Increasing the operational speed of electrically or hydraulically powered boat lifts can require the use of inordinately large equipment and amounts of electrical power. Conventionally, a boat lift that relies on the boat to power itself up and onto a buoyant structure would likely have limited utility for larger boats, which would require flotation devices with a relatively large surface area to achieve the necessary buoyancy. This could make such devices incompatible with covered docks that have limited available space. Likewise, launching large, heavy boats docked with such devices is more difficult, as well.

In short, there are myriad boat lift permutations incorporating one or more of the features discussed above. However, none is completely satisfactory as a boat lift for many existing types and sizes of boats and other water craft, nor are they all adaptable for use with different configurations and sizes of docks.

SUMMARY OF THE INVENTION

It is an object of the present invention to provide a boat lift that overcomes the aforementioned drawbacks, by using the boat's own propulsive thrust to provide the power for operating a boat lift mechanism, which eliminates the need for electrical or hydraulic power at the dock, while providing rapid launch and retrieval of the boat, and providing compatibility with the constrained space associated with covered docks.

In accordance with a first aspect of the invention, a boat lift for lifting a boat above a water level at which it normally floats comprises a lift frame with attachment points for movably attaching the lift frame to a boat dock and a boat cradle for accepting the boat, a first movable lift member mounted on the lift frame for movement relative thereto, the first lift member including a flotation device for exerting on the lift frame an upward force sufficient to lift the boat above the water level at which it normally floats, a second movable lift member mounted on the lift frame for movement relative thereto by engagement with the boat as the boat propels itself onto the boat cradle to perform a docking operation, and a linkage between the first and second movable lift members for providing movement of the first lift member in response to movement of the second lift member by the boat, wherein movement of the first lift member displaces the flotation device and exerts the upward force on the boat.

In accordance with a more specific embodiment of the invention, the attachment points mount the lift frame to the dock for rotation about an axis generally transverse to the direction the boat propels itself onto the boat cradle, the second movable lift member includes a second trolley mounted on the lift frame for sliding movement generally parallel to the direction the boat propels itself onto the boat cradle, and the first movable lift member includes a first trolley mounted on the lift frame for sliding movement generally parallel and opposite to the direction of sliding movement of the second trolley, the flotation body being disposed in the water when the lift frame is mounted to the dock.

Additional aspects of the invention include such a boat lift wherein the linkage is a mechanical linkage, which optionally can comprise at least one cable attached to the first and second trolleys and having an intermediate portion between the trolleys passing over at least one pulley mounted to the lift frame. A particularly advantageous embodiment has two such pulleys to cause the lower trolley to halve the distance travelled by the first trolley relative to the distance travelled by the second trolley.

In yet another aspect of the invention, the boat lift as installed in the boat dock has the lift frame resting in a boat receiving position with the boat cradle positioned relative to the water level for accepting the hull of the boat, and the boat lift further comprises a releasable second trolley lock for securing the second trolley in a terminal position into which it has been moved by the boat after completion of a docking operation that moves the boat lift into a final docking position, in which the second trolley lock prevents movement of the second trolley in a direction opposite to the direction of boat travel during the docking operation, and a releasable boat retainer moved into a boat retaining position by the first trolley for retaining the boat in place on the boat cradle when the second trolley is locked in the terminal position thereof. In an advantageous variation of this aspect of the invention, the dock cooperates with the lift frame in the final docking position to hold the lift frame relative to the water line in a position at which a force is exerted on the first trolley urging it in a direction opposite to the direction it traveled during the docking operation.

The invention also includes method aspects, the most general of which involves a method of lifting a boat above a water level at which it normally floats by propelling the boat onto a boat lift having a lift frame attached to a boat dock for rotation generally transverse to a direction the boat propels itself onto the boat lift, the frame including a boat cradle for accepting the boat, a first trolley mounted on the lift frame for sliding movement generally parallel to the direction the boat propels itself onto the boat lift, the first trolley including a flotation device disposed in the water for exerting on the lift frame an upward force sufficient to lift the boat above the water level at which it normally floats, a second trolley mounted on the lift frame for sliding movement when engaged by the boat as the boat propels itself onto the boat cradle, and a linkage between the first and second trolleys for moving the first trolley in a direction generally parallel and opposite to movement of the second trolley. With such a boat lift, the method comprises using the boat's propulsive power to propel the boat onto the boat cradle when the lift frame is rotated to a boat receiving position with the boat cradle positioned relative to the water level for accepting the hull of the boat, continuing to apply the boat's propulsive power until the boat lift attains a rotated docking position with the second trolley moved to a terminal position by the boat and the lift frame remaining in the boat receiving position, locking the second trolley in the terminal position and thereafter terminating the boat's propulsive power thereby to allow the flotation device on the first trolley to move to a position in which the boat assumes a final docking position at a level above which it normally floats in the water, and actuating a boat retainer with the first trolley to hold the boat on the boat cradle in the final docking position.

The method can advantageously be carried out with the flotation device shaped to exert a force on the boat lift in the presence of water flow induced by the propulsive power of the boat tending to maintain the boat lift in the rotated docking position. The boat lift can optionally include a mechanism such as a gas strut for assisting in maintaining the boat lift in the rotated docking position during application of the boat's propulsive power.

The method aspects of the invention also include a step of launching the boat. In that respect, the dock cooperates with the lift frame in the final docking position to hold the lift frame relative to the water line in a position at which a force is exerted on the first trolley urging it in a direction opposite to the direction it traveled during the docking operation. Launching the boat is effected by releasing the second trolley lock to permit the first trolley to move in the direction of the force so that the lift frame rotates toward the boat receiving position, wherein gravity urges the boat off of the boat cradle.

BRIEF DESCRIPTION OF THE DRAWINGS

The objects of the invention will be better understood from the detailed description of its preferred embodiments which follows below, when taken in conjunction with the accompanying drawings, in which like numerals and letters refer to like features throughout. The following is a brief identification of the drawing figures used in the accompanying detailed description.

One skilled in the art will readily understand that the drawings are not strictly to scale, but nevertheless will find them sufficient, when taken with the detailed descriptions of preferred embodiments that follow, to make and use the present invention.

DETAILED DESCRIPTION OF PREFERRED EMBODIMENTS

Figure 1:
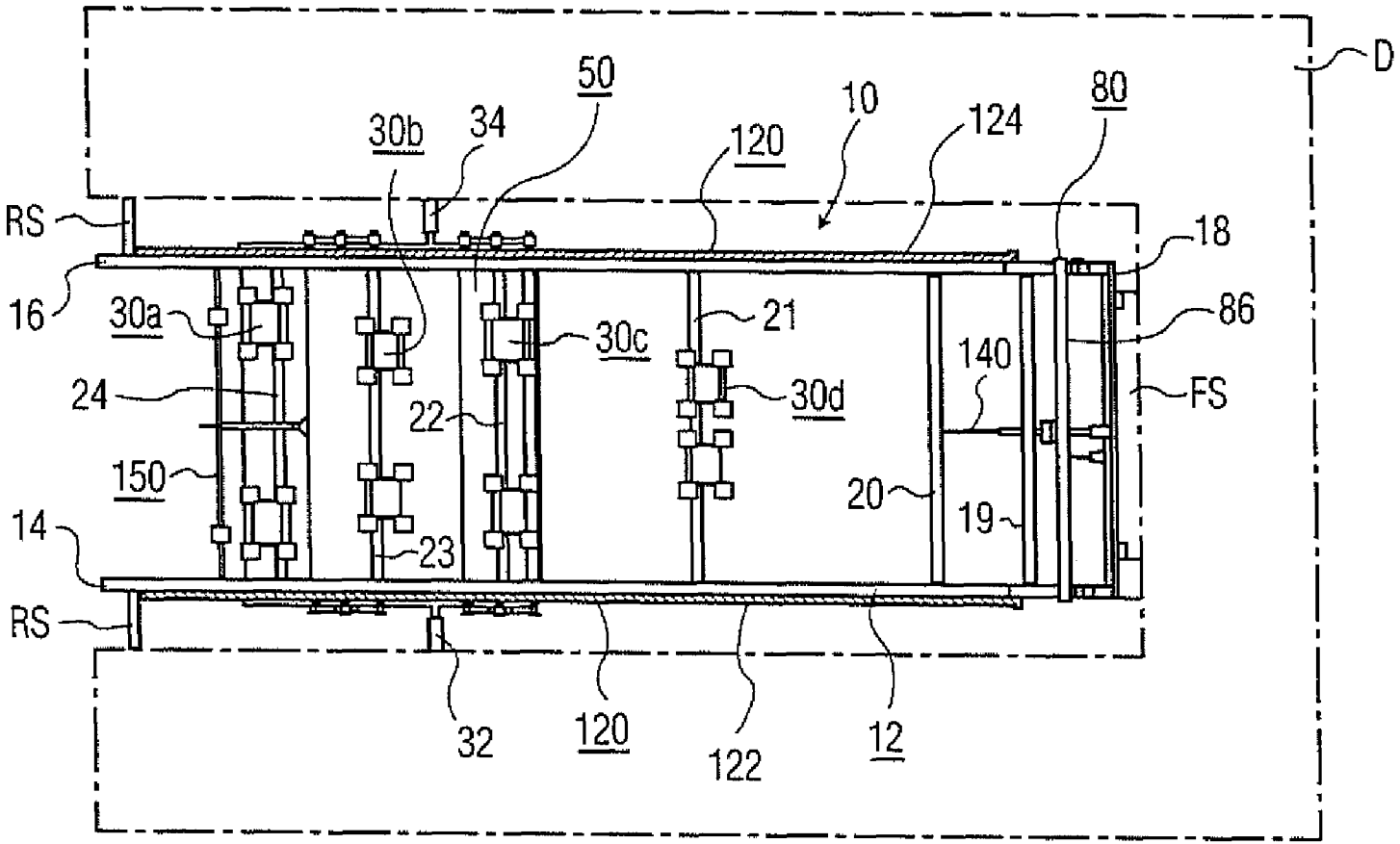
FIG. 1 is a top view of an embodiment of a boat lift in accordance with the present invention, showing the mounting of the boat lift frame to a boat dock.
Figure 2:
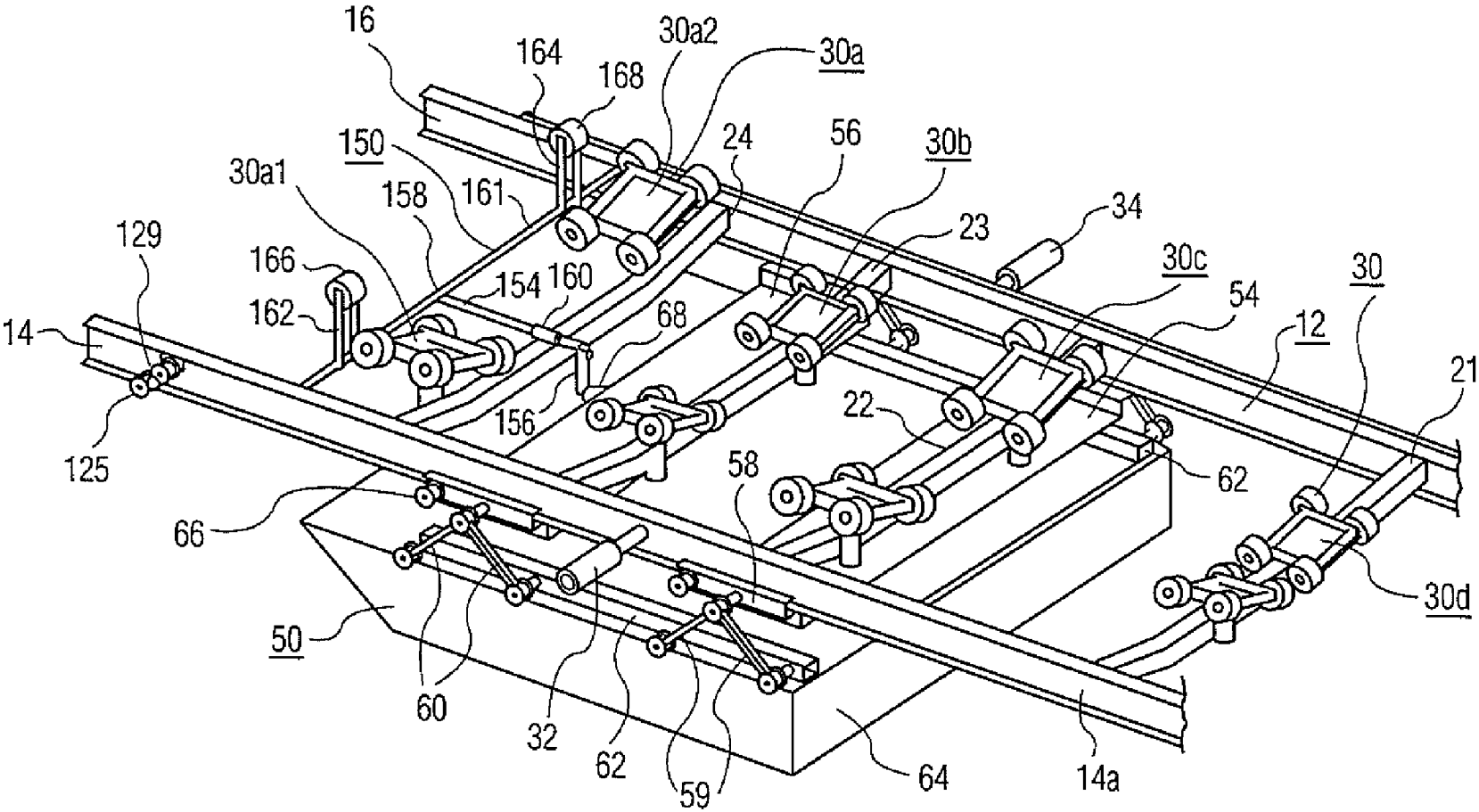
FIG. 2 is a perspective view of a portion of the boat lift embodiment depicted in FIG. 1, showing details of the boat cradle and lower trolley (first movable lift member).

Referring to FIGS. 1 and 2, a boat lift 10 in accordance with a first embodiment of the present invention includes a lift frame 12 that has two generally parallel side rails 14 and 16 connected by cross braces 18, 19, 20, 21, 22, 23 and 24. The number and placement of the cross members is optional, their purpose being to provide sufficient rigidity to the frame 12 to accomplish the purposes of the boat lift in accordance with this description. The frame 12, with side rails 14 and 16 and cross braces 18 to 24, will typically be a unitary, welded structure, but those skilled in the art will appreciate that the frame can be fabricated in other ways as well. The frame 12 also includes a boat cradle 30 that comprises a plurality of roller assemblies 30*a*, 30*b*, 30*c* and 30*d*. Taking as representative the roller assembly 30*a*, it includes two roller dollies 30*a*1 and 30*a*2, each of which is supported on the frame cross brace 24. In the depicted embodiment, each roller dolly includes four hard rubber or nylon rollers, but other numbers of rollers can be used as well. The rollers are slightly canted relative to horizontal to generally match the angle presented by the hull of the boat B (see FIGS. 5 to 8) as it rests on the rollers. In a preferred embodiment, the boat supporting roller dollies can be mounted to permit the angle presented by the rollers to the boat hull to vary through a limited range. This will permit the boat lift both to accommodate boat hulls of different shapes and sizes, and to provide optimum support for the boat as the boat hull presents different angles to the dollies as the boat moves relative to the frame during a docking operation (to be described below). Conventional boat trailers have long used this type of boat cradle to support boats of different sizes and hull shapes as they are pulled axially onto the trailer for transport, and the boat cradle of the present embodiment is similar to that conventional structure.

The frame 12 also includes two pivot axles 32 and 34 that are rigidly attached to the side rails 14 and 16, respectively.

The pivot axles extend into cooperating bosses (not shown) in a supporting structure, such as the dock D shown in dot-dash lines in the figures. The dock can assume various forms, and can be a floating dock, a fixed dock, and can be covered or open, the present invention being adaptable for use with almost any type of dock structure. The pivot axles 32 and 34 comprise attachment points for the frame 12, and thus for the boat lift, for supporting it relative to the dock. The pivot axles are located along the frame in accordance with principles discussed in more detail below. The entire frame 12 is freely rotatable as a unitary structure around the transverse axis established by the pivot axles 32 and 34. The pivot axles 32 and 34, and hubs (not shown) in the dock D, are of suitable construction to permit rotation of the frame 12 relative to the dock while the boat B is supported on the frame by the boat cradle 30. Those skilled in the art will recognize that other mounting arrangements are possible, such as a single axle extending between the sides of the dock.

The boat lift 10 further includes a lower trolley 50 (seen in more detail in FIG. 2), that provides a first movable lift member of the boat lift. As such, the lower trolley includes hanger structure comprising a front hanger bracket 54 and a rear hanger bracket 56. The hanger brackets 54 and 56 are each mounted in similar fashion to the side rails 14 and 16 of the frame 12. For the sake of simplifying this description, only the mounting arrangement of the front hanger bracket 54 will be described in detail, but it will be understood that the rear hanger bracket 56 includes components corresponding to those described in connection with the front hanger bracket 54.

To that end, the front hanger bracket 54 spans the distance between the side rails 14 and 16 of the frame 12 and terminates at each end in a C-shaped rail track 58. FIG. 2 shows one end of the front hanger bracket 54, with the inner sides of the top and bottom of the "C" facing the top and bottom faces of an outwardly extending flange 14*a* at the bottom of the frame side rail 14. Rollers (not shown) attached to the side of the "C" fit between the inner sides of the top and bottom of the "C" and the faces of the flange 14*a*. This low friction roller arrangement permits the hanger bracket to slide easily along the side rail 14. A similar C-shaped rail track (not shown) is formed at the other end of the front hanger bracket 54 to provide a similar low friction roller arrangement between itself and the side rail 16. Likewise, the rear hanger bracket 56 is mounted to the side rails 14 and 16 in the same fashion. These low friction mountings permit the hanger brackets to move freely forwardly and rearwardly on the side rails 14 and 16. (In describing embodiments of the invention, terms indicating direction or orientation, such as "front," "rear," "top," "bottom," "right," "left," etc., are used to facilitate the description. They do not imply that the invention is limited to a particular orientation of the boat lift.)

The hanger brackets 54 and 56 are rigidly connected together by a truss arrangement at the end of each hanger bracket. Taking the truss arrangement in the foreground of FIG. 2, a pair of front links 59 and a pair of rear links 60 are connected to the ends of the front hanger bracket 54 and the rear hanger bracket 56, respectively, where they are mounted to the side rail 14. A hollow square girder 62 connected between the links 59 and 60 cooperate with the links 59 and 60 to form a rigid truss. A similar truss arrangement (only parts of which are visible in FIG. 2) connects the other ends of the hanger brackets 54 and 56 mounted to the side rail 16. A low-density buoyant body 64 rigidly connects the two square girders 62 to each other. Thus, the truss arrangement provided by the links 59 and 60 and the square girders 62, along with the buoyant body 64, provide a rigid, unitary hanger structure that comprises the lower trolley movable lift member 50. The buoyant body 64 can assume different forms. It may be fabricated from sheet metal as an air-tight drum, so that it will function as a flotation device in accordance with the description further below. In another preferred embodiment, it can be a hollow body filled with a low-density foam material, such as Styrofoam® expanded polystyrene. In any case, the buoyant body 64 is also strong enough to satisfy its concomitant structural function of rigidly connecting together the pairs of hanger brackets 54 and 56 mounted on opposed side rails 14 and 16. Those skilled in the art will recognize that a unitary hanger structure can be provided by other arrangements, and that the invention is not limited by this description of one manner of doing so.

The rear hanger bracket 56 includes two additional components. First, a lower trolley drive pulley 66 located at the rear portions of both ends of the bracket 56 (only one pulley 66 is visible in FIG. 2) provide for a connection to a mechanical linkage that links the lower trolley to an upper trolley described just below. Second, an actuation tab 68 extends from the rear of the hanger bracket 56 for cooperating with a boat retainer to be described that secures the boat in place after it has been lifted out of the water and is in its final docking position. The tab 68 is described in more detail below in connection with the operation of the boat lift.

Figure 3:
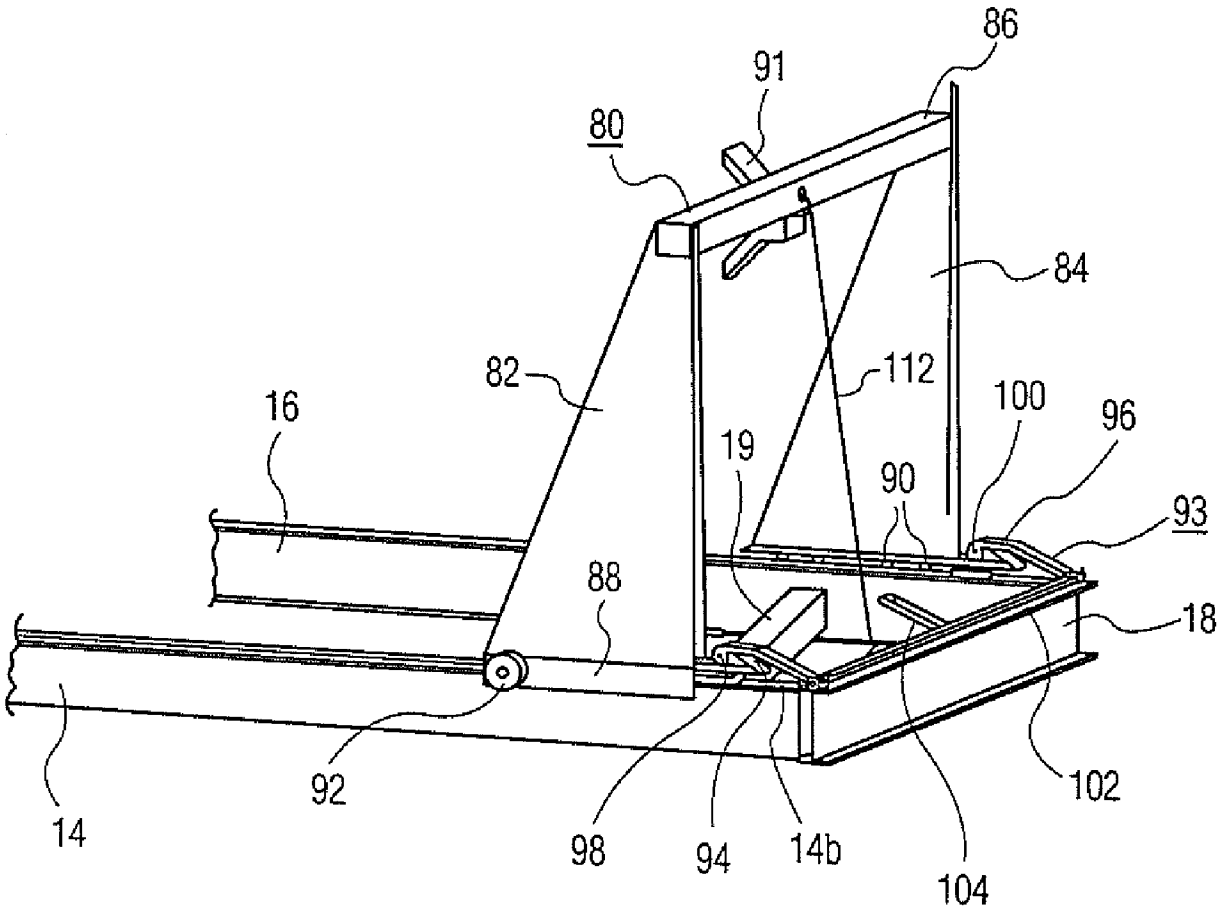
FIG. 3 is a perspective view of a portion of the boat lift embodiment depicted in FIG. 1, showing details of the upper trolley (second movable lift member) and the upper trolley lock.

FIG. 3 shows an upper trolley 80 that provides a second movable lift member of the boat lift. (FIG. 3 omits the boat dock D for clarity.) As such, the upper trolley includes generally right-triangular upright plates 82 and 84 connected by a square-girder cross bracket 86 welded between the upper ends of the upright plates 82 and 84. The side plates are mounted in similar fashion to the side rails 14 and 16 of the frame 12. For the sake of simplifying this description, only the mounting arrangement of the upright plate 82 will be described in detail, but it will be understood that the other side plate 84 includes components corresponding to those described in connection with the upright plate 82.

To that end, one side of the upright side plate 82 includes a C-shaped rail track 88 similar to that described above in connection with the lower trolley hanger brackets. Inner sides of the top and bottom of the "C" face the top and bottom faces of an outwardly extending flange 14*b* at the top of the frame side rail 14. Rollers (not shown) are attached to the side of the "C" and are disposed between the inner sides of the top and bottom of the "C" and the faces of the flange 14*b* to form a low friction roller arrangement between the side rail 14 and the upright plate 82. The other side plate 84 similarly mounts to the side rail 16, and the rollers 90 in that rail track are visible in FIG. 3. These low friction mountings permit the upright plates 82 and 84 to move freely forwardly and rearwardly on the side rails 14 and 16.

The upper trolley 80 includes a bow stop 91 into which the bow of the boat B fits during a docking operation using the boat lift 10, as described in more detail further below. The bow stop is conveniently formed from a piece of metal mounted to the cross bracket 88 and is suitably padded to protect the boat's finish. In a preferred embodiment, the bow stop 91 is movably mounted to the cross bracket 88 so that it can be located most advantageously for the particular boat that is used with the boat lift. In addition, a boss 92 located at a rear portion at the bottom of each side plate 82 and 84 (only the boss on side plate 82 is visible in FIG. 3) provides for connecting the upper trolley and the lower trolley through a mechanical linkage, also as described further below in connection with the operation of the boat lift.

Two other features of the upper trolley 80 come into play during use of the boat lift, as will be described below. First, a trolley lock 93 includes two hooks 94 and 96 on the side plates 82 and 84, respectively. The hooks 94 and 96 cooperate with latches 98 and 100, respectively, on a rod 102 mounted to the frame 12 for rotation about the axis of the rod. The rod 102 is biased in a suitable manner into the position shown, in which the latches 98 and 100 engage the respective hooks 94 and 96 to secure the upper trolley in the parked position shown in FIG. 3. A handle 104 attached to the rod is used to manually rotate the rod 102 in a clockwise direction (as seen in FIG. 3), against the biasing force on the shaft, which releases the hooks 94 and 96 to permit movement of the upper trolley along the side rails 14 and 16. This biasing force can be provided by gravity acting on latches 98 and 100 and the handle 104, as in the embodiment depicted in FIG. 3, or by other suitable means, such as a torsion spring.

Second, an upper trolley retainer comprises a retainer cable 112 attached at one end to the cross bracket 86 and wound at the other end around a spring loaded pulley (not shown) attached to the cross brace 18 of the frame 12. The trolley retainer prevents unwanted movement of the upper trolley due to the slight tension maintained on the retainer cable 112 by the spring loaded pulley. The spring force is sufficiently strong to prevent the upper trolley 80 from sliding on its own when the trolley lock is released, but does not otherwise interfere with desired movement of the trolley during operation of the boat lift.

Figure 4A:
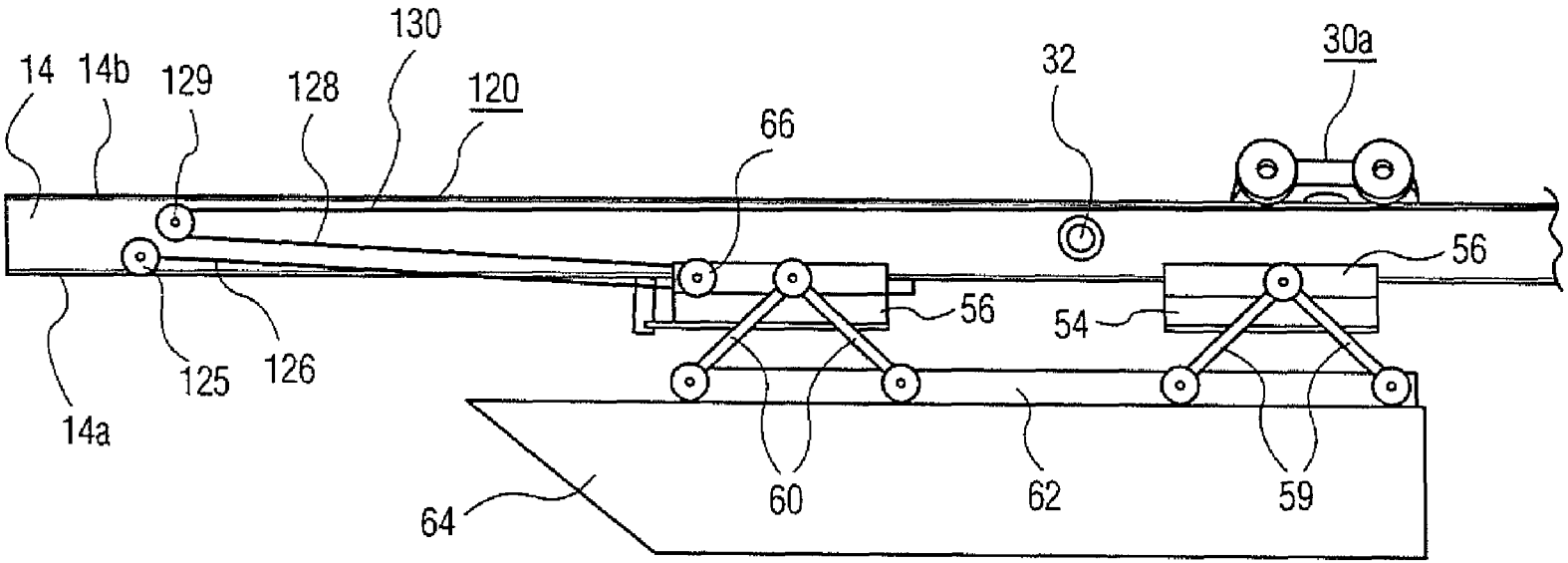
FIGS. 4A and 4B are enlarged side views of the rear end and front end, respectively, of the boat lift embodiment depicted in FIGS. 1 to 3, showing details of the mechanical linkage between the upper and lower trolleys.
Figure 4B:
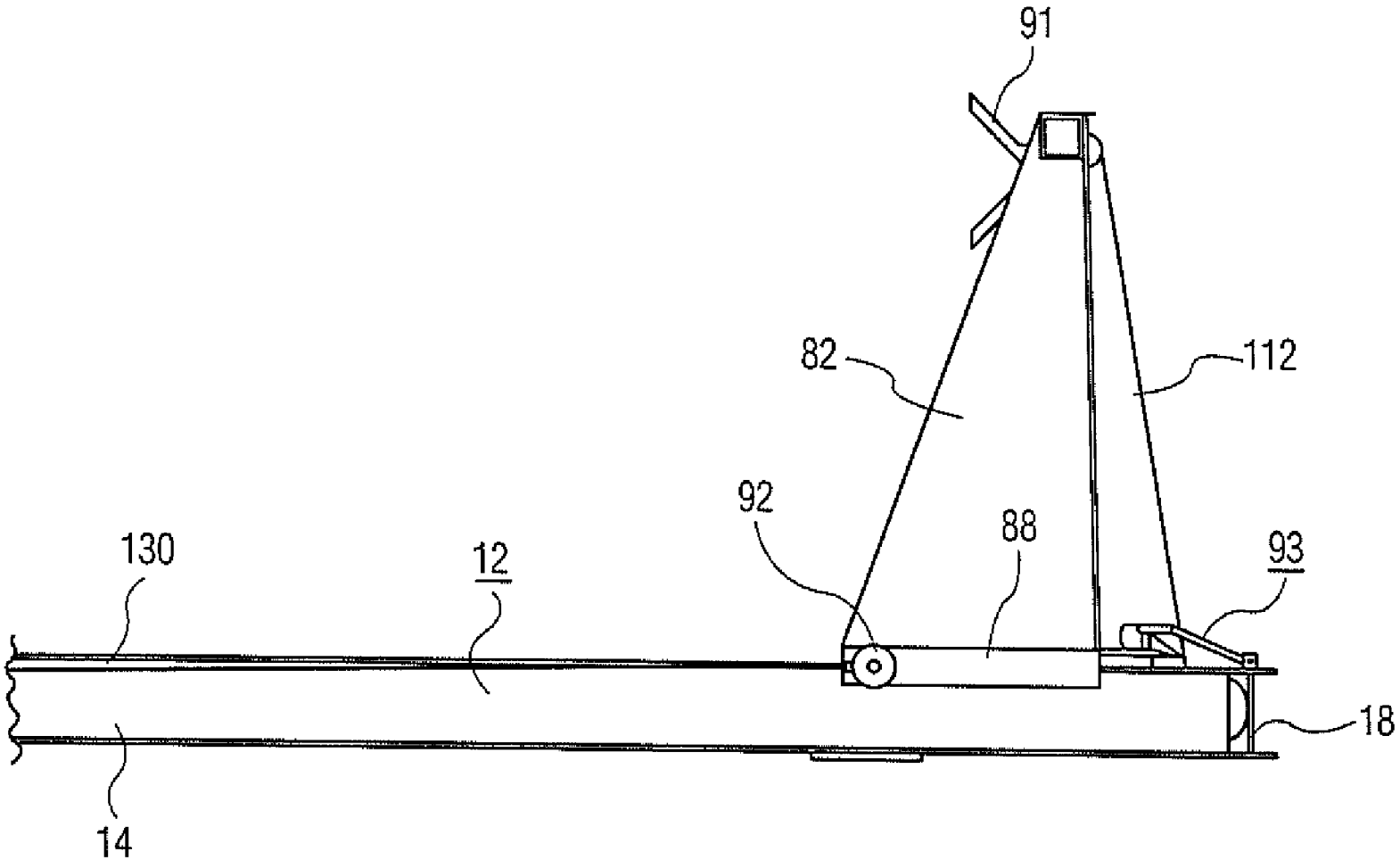

FIG. 4A is a detail view of the rear of the boat lift 10, and FIG. 4B is a corresponding detail view of the boat lift's front end. Taken together, these two views illustrates the linkage 120 used in the present embodiment between the lower trolley 50 and the upper trolley 80. In this embodiment the upper and lower trolleys are linked mechanically by two cables 122 and 124, each being connected in an identical fashion between the lower trolley and upper trolley at a side of the frame. (FIGS. 2 and 3 omit the cables for clarity.) FIGS. 4A and 4B show the cable 122 that is on the side of the frame 12 where the side rail 14 is located. The cable is anchored at one end to an anchor boss 125 on the frame side rail 14. A first cable run 126 extends from the anchor boss 125 around the lower trolley pulley 66, and from there a second cable run 128 passes around a frame pulley 129, followed by a third cable run 130, the end of which is attached to the upper trolley anchor boss 92. The cable mechanical linkage 120 causes the lower trolley 50 and upper trolley 80 to translate in opposite directions along the frame side rails 14 and 16: boat docking forces forward movement of the upper trolley 80, which in turn causes rearward movement of the lower trolley 50, and boat launching causes forward movement of the lower trolley and concomitant rearward movement of the upper trolley. The cable linkage 120 halves the distance traveled by the lower trolley 50 relative to the distance traveled by the upper trolley 80.

Boat Lift Operation

The operation of the boat lift 10 is illustrated in FIGS. 5 to 8. Starting with FIG. 5, the boat lift is shown in a resting, boat-receiving position. The lift is in this position after a boat is launched from the lift, as explained further below. The lift is stably held in this position, principally by virtue of the placement of the hollow flotation body 64 to the right (in FIG. 5) of the lift's rotational axis established by the pivot axles 32 and 34 when the lift is in this position. Counterclockwise rotation of the frame 12 is limited by a rear dock stop RS, which comprises a bracket that has a depending portion secured at its upper end to the dock D and a restraining portion extending horizontally at the lower end of the depending portion. The construction of the rear dock stop and its orientation relative to the boat lift 10 and the dock D can best be seen in FIGS. 1, 5, and 8. An optional gas strut 140 secured between the dock D and the frame cross member 20 (see also FIG. 1) limits the rate of rotation of the boat lift around the pivot axles 32 and 34, thereby also assisting in the docking operation, as will be apparent as the following description proceeds.

Figure 5:
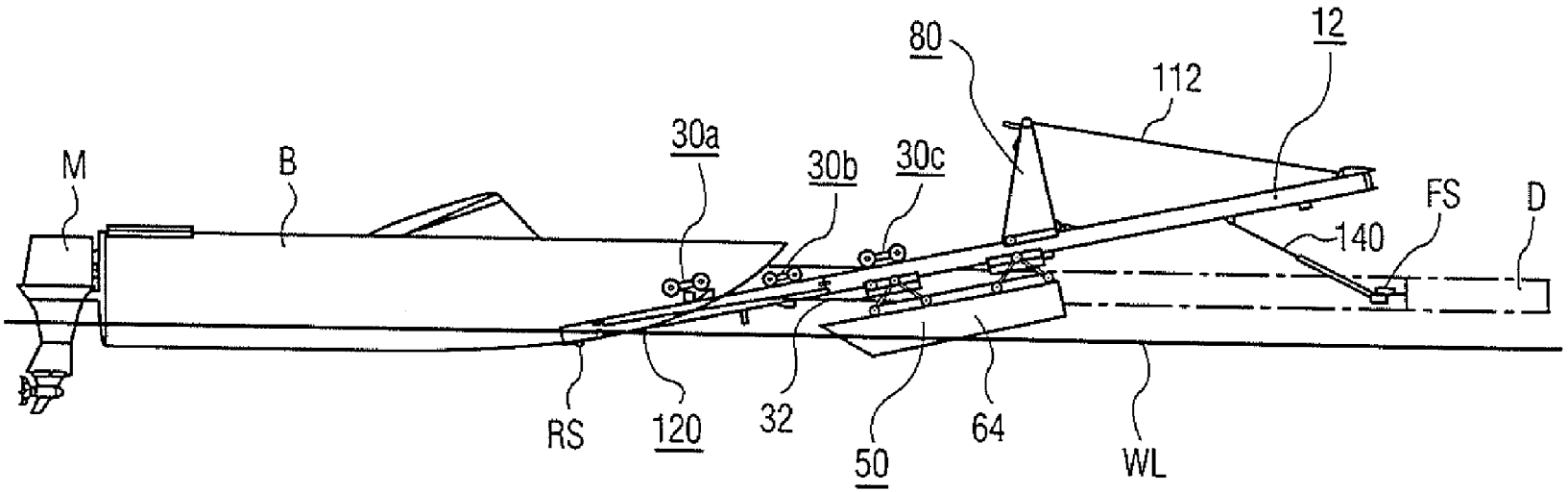
FIG. 5 is a side view of the boat lift in FIGS. 1 to 4 in its boat receiving position.
Figure 6:
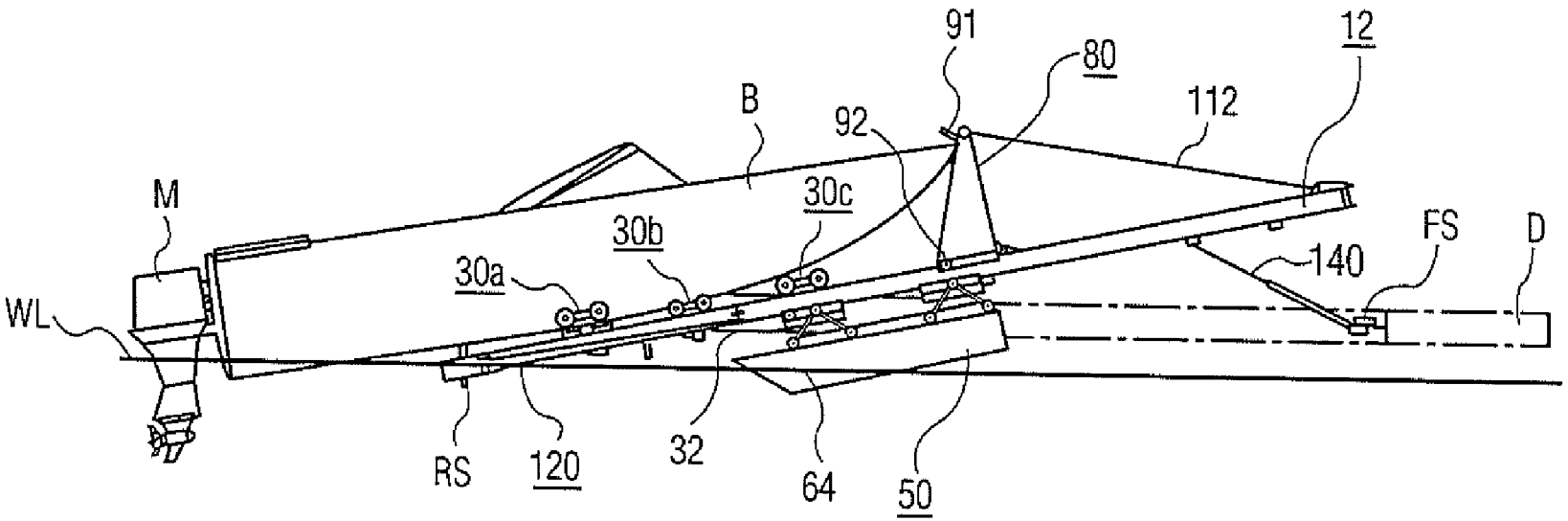
FIG. 6 is a side view of the boat lift in FIGS. 1 to 4 with the boat in an intermediate docking position after the boat has propelled itself partially onto the boat cradle and into engagement with the upper trolley.

The rear dock stop RS is positioned on the dock D and dimensioned so that the rollers on the rearmost roller assembly 30*a* of the boat cradle 30 are at a vertical position relative to the water level WL that enables the roller assembly 30*a* to accept the hull of the boat B as the boat moves forward. In that regard, FIG. 5 shows the boat B approaching the boat lift 10 powered by its own propulsion system, such as an aft-mounted outboard motor M. The boat operator continues to power the boat forward onto the roller assemblies of the boat cradle, and thus onto the lift, and the boat eventually reaches an intermediate docking position shown in FIG. 6. At this point, the bow of the boat engages the bow stop 91 on the upper trolley 80 and as the boat propels itself further onto the boat lift along the boat cradle rollers, it moves the upper trolley 80 forward (to the right in the drawings). As the upper trolley moves forward, the lower trolley moves rearward (that is, in the opposite direction) through the action of the cable linkage 120. It will be understood that the docking operation would not normally be interrupted as it proceeds, and FIGS. 5 and 6 are in the nature of "snapshots" for explaining how the boat lift 10 operates as the normally continuous docking operation proceeds.

Figure 7:
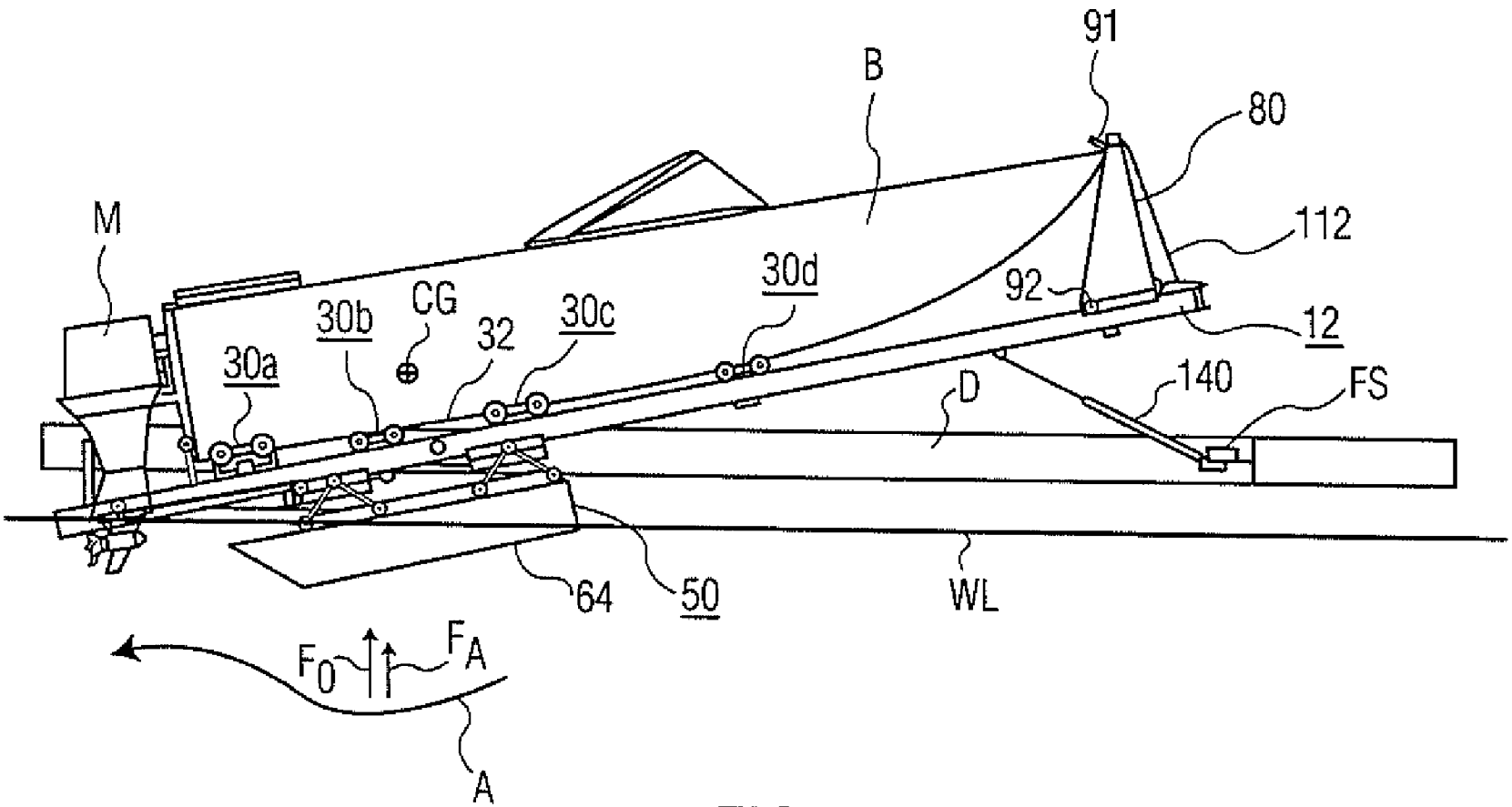
FIG. 7 is a side view of the boat lift in FIGS. 1 to 4 after the boat has propelled itself fully onto the boat lift, moving the upper trolley into its terminal forward position and the boat lift into the rotated docking position.

FIG. 7 shows the boat fully on the boat lift with the upper trolley 80 in its forwardmost position and the lower trolley 50 in its rearwardmost position. The boat lift is maintained in this rotated docking position as long as the boat's propulsion system is operating, thus permitting the boat to be propelled under its own power fully onto the lift 10, as explained in more detail just below. The retainer cable 112 is taken up by the spring loaded retainer pulley on the frame cross brace 18 (see FIG. 3 and accompanying text above) as the boat propels itself forward onto the boat lift. When the upper trolley reaches its forwardmost position, the inclined camming surfaces on the tops of the upper trolley lock hooks 94 and 96 push up on cooperating rounded camming surfaces at the ends of the latches 98 and 100 (see FIG. 3), at which point the latches engage the hooks to hold the upper trolley in the position shown in shown in FIGS. 3 and 7.

The boat lift 10 is held in the rotated docking position shown in FIG. 7 as long as the boat motor M produces forward thrust on the boat. This is accomplished in two ways in the present embodiment. First, a hydrodynamic force is created by water flow around flotation body 64, schematically illustrated by the arrow A. This water flow is induced by the motor M (more precisely, by the boat's propeller), and the body 64 has a shape that produces downward "lift" in the presence of the flow A. The upward force produced by the flotation body 64, which is to the left of the frame pivot axis established by the pivot axles 32 and 34 when the lower trolley 50 is in its rearwardmost position as shown in FIG. 7, produces a clockwise rotational moment on the boat lift. The force $F_A$ represents the difference between the upward buoyant force exerted by the flotation body 64 in this position and the downward lift produced by the shape of the flotation body in the presence of the water flow A. The boat lift is designed so that the ultimate counterclockwise rotational moment on the boat lift due to the weight distribution of the boat lift itself and the location of the boat center of gravity CG maintains the boat lift in the rotated docking position shown in FIG. 7, even in the presence of the resultant upward force $F_A$. In addition, the gas strut 140 assists in keeping the boat lift in this position until the power to the motor M is terminated, by damping any tendency of the boat lift to rotate in the opposite (clockwise) direction. The gas strut damps fluctuations in the downward "lift" on the flotation body 64 due to the extreme turbulence of the water flow A when it interacts with the dock supporting structure. Accordingly, since the water flow may not generate a sufficiently steady downward force, the gas strut 140 prevents the boat lift from rotating in a clockwise direction in the presence of momentary fluctuations in the lift.

When the boat operator is certain that the boat is fully on the boat lift and the upper trolley lock 93 is firmly engaged, the operator cuts the power to the motor M. At that time, the flow A ceases and the downward lift on the flotation tank 64 is eliminated. The resulting upward force $F_0$ is sufficient to create a clockwise moment on the boat lift and it rotates into the final docking position shown in FIG. 8. The gas strut 140 controls the rate at which the boat lift rotates, and the boat is accordingly gently lowered until the frame cross brace 18 comes gently to rest on the front dock stop FS. It will be appreciated by those skilled in the art that in some installations, the dock dimensions and boat characteristics may make it possible to forego the use of a damper such as the gas strut 140.

The boat B is held securely in place by a boat retainer 150 mounted on the frame 12, seen in detail in FIG. 2. The boat retainer includes a crank arm comprising a L-shaped link 154 with an actuating arm 156 at one end. The other end of the link 154 is pivotally connected to one end of a crank arm 158. The link 154 is mounted for sliding movement in a bracket 160 on the frame cross member 24. In the embodiment illustrated, the end of the crank arm 158 is slotted to permit rotation of the crank arm in response to sliding linear movement of the link 154, but other connection configurations are possible. The other end of the crank arm is part of a boat retaining arm that includes a shaft 161 spanning the frame side rails 14 and 16 for rotation about the shaft axis. The shaft 161 also includes boat retainer arms 162 and 164 rigidly connected at one end to the shaft. Each boat retainer arm has at its other end a roller 166 and 168 for engaging the back of the boat when the boat retainer is actuated by the actuation tab 68 on the lower trolley 50.

Figure 8:
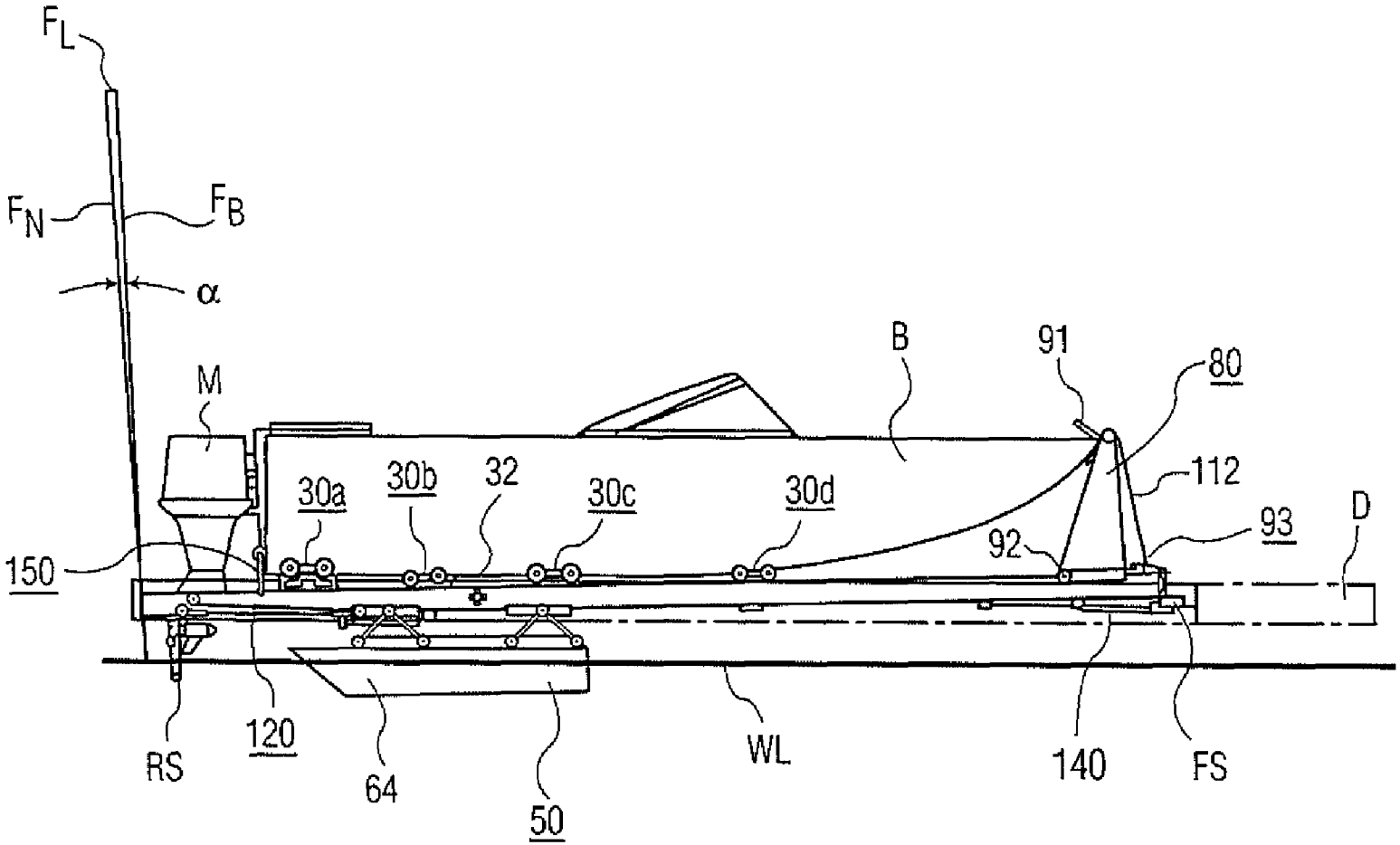
FIG. 8 is a side view of the boat lift in FIGS. 1 to 4 in its final docking position, with the boat completely out of the water and its propulsion system deactivated.

In the rearwardmost position of the lower trolley 50 shown in FIG. 8 (and FIG. 2), the actuation tab 68 has engaged the actuating arm 156 of the boat retainer link 154, thus urging the link rearward (to the left in FIGS. 2 and 8) and rotating the shaft 161 in a clockwise direction through the action of the crank arm 158. In this position, the rollers 166 and 168 engage the back of the boat B, as seen in FIG. 8, and prevent it from rolling off the boat lift in the aft direction. The lower trolley is held in this position by the cable linkage 120, which is connected to the upper trolley, which itself is locked in position by the upper trolley lock 93. The boat is thus lifted out of the water and held securely in place on the boat lift, using only the propulsive force of the boat itself without the use of any other source of power.

Launching the Boat from the Boat Lift

The first step in launching the boat is to release the upper trolley lock 93 by manually lifting the handle 104 (see FIG. 3) to release the latches 98 and 100. This permits the upper trolley 80 to move rearwardly, thus releasing the lower trolley 50 to move forwardly (to the right in FIGS. 2 and 8), which will permit forward sliding movement of the link 154 of the boat retaining arm in the bracket 160. That in turn will permit rotation of the shaft 161 in a counterclockwise direction as seen in FIG. 2, thus permitting the boat retainer arms 162 and 164 to rotate out of the way of rearward movement of the boat B.

FIG. 8 illustrates forces acting on the boat in the final docking position as a result of the configuration of the boat lift. These forces assist in launching the boat when the upper trolley lock is released as described above. The force $F_B$ is the force normal to the surface of the water that is exerted on the boat lift 10 by the buoyant flotation body 64. The forward dock stop FS is located at a height above the water level that holds the boat lift frame 12 at a slight angle $\alpha$ relative to the water line WL. (The angle $\alpha$ is the angle between horizontal, that is, the water line WL, and the side rails 14 and 16 of the lift frame 12.) As a result of the boat lift being held at this angle, the force $F_B$ has a component $F_N$ acting normal to the plane of the side rails 14 and 16, establishing the component $F_N$ at the angle $\alpha$ relative to the force vector $F_B$. More importantly, as explained in the next paragraph, there is also a component force $F_L$ on the side rails 14 and 16 acting to the left as seen in FIG. 8 and having a magnitude $F_L=F_B*\sin\alpha$, and the lower trolley 50 is accordingly urged to the right by a force with the same magnitude $F_L$. However, the cable linkage 120 prevents the lower trolley from sliding along the side rails because its other end is attached to the upper trolley 80, which is locked in place by the upper trolley lock 93.

Upon release of the upper trolley lock, the force $F_L$ urges the lower trolley to the right in FIG. 8, and the upper trolley and the boat are pulled to the left by the cable linkage 120. Thus, the boat begins to roll off the boat cradle 30, assuming the various positions in FIGS. 4 to 7 (in reverse order) as it rolls off the boat lift. As the lower trolley is moved to the right in the figures, the torsion-spring loaded take-up pulley of the retainer cable 112 restrains movement of the upper trolley to prevent the cable linkage 120 from becoming slack during boat launching. As the lower trolley thus moves to the right, the buoyant force $F_B$ eventually acts at a location to the right of the pivot axis of the boat lift. At this point, the boat is in the position shown in FIG. 6, and can be easily rolled off of the boat lift cradle into the water. The gas strut 140 assists in controlling the rate of rotation of the boat lift to gently lower the boat into the water. At the end of a launching operation, the boat lift occupies the position shown in FIG. 5, where it is stably held as previously discussed, ready to accept a boat for docking again.

General Principles and Alternate Embodiments

Those skilled in the art will appreciate that the particular boat lift embodiment described above and depicted in FIGS. 1 to 8 achieves an important object of the present invention in that it enables a boat to be lifted above the level at which it floats on the water using the boat's own propulsive power. The invention would also include such a boat lift that only partially raises the boat from the level at which it normally floats in the water, as well as many other variations on the specific structure disclosed herein. While the intent is not to claim all structure and methods for using a boat's own propulsive power to lift the boat, the scope of the invention is, nevertheless, broadly directed to a boat lift with one component (the upper trolley in the described embodiment) driven by the boat and another component (the lower trolley in the described embodiment) that displaces a flotation body into a position to lift the boat in response to movement of the one component.

To that end, specific variations in the structure described above and depicted in FIGS. 1 to 8 could include different manners of linking the first and second movable lift members. For example, they could be linked by a rack-and-pinion gearing mechanism, a lever mechanism, or hydraulically. In addition, although the 2:1 mechanical advantage in the described embodiment (upper trolley displacement÷lower trolley displacement) has been found to be particularly advantageous, other mechanical advantages are clearly within the scope of the invention.

Other variations on the disclosed embodiments that would fall within the scope of the invention are different sizes and shapes of the flotation body 64. Simply as one example, different shapes could prove more advantageous for different dock configurations or boat propulsion systems (such as inboard motor propelled boats) in maintaining or assisting in maintaining the lift in the intermediate docking position shown in FIG. 7. Another variation involves making the location of the flotation body relative to the frame adjustable to accommodate different size boats or different conditions at the dock (such as shallow water). This could be accomplished by attaching the flotation body to the lower trolley with an adjustable lever arm instead of the rigid truss structure described above.

Those skilled in the art will readily recognize that only selected preferred embodiments of the invention have been depicted and described, and it will be understood that various changes and modifications can be made other than those specifically mentioned above without departing from the spirit and scope of the invention, which is defined solely by the claims that follow.

What is claimed is:

1. A boat lift for lifting a boat above a water level at which it normally floats, the boat lift comprising:

a lift frame with attachment points for movably attaching said lift frame to a boat dock and with a boat cradle for accepting the boat and permitting the boat to move relative to said lift frame to define a docking direction along which the boat propels itself during a docking operation;

a first movable lift member mounted on said lift frame for movement relative to said lift frame generally parallel to the docking direction, said first lift member including a flotation device for exerting on said lift frame an upward force sufficient to lift the boat above the water level at which it normally floats;

a second movable lift member mounted on said lift frame for engaging the boat during a docking operation to move said second lift member relative to said lift frame generally parallel to the docking direction; and a linkage operatively connecting said first and second movable lift members for moving said first lift member relative to said lift frame in a direction different from the direction of movement of said second lift member, wherein said movement of said second lift member by the boat during a docking operation displaces said flotation device toward a location relative to said attachment points where said upward force can lift the boat.

2. A boat lift as in claim 1, wherein:

said attachment points are constructed to mount said lift frame to the dock for rotation about an axis generally transverse to the docking direction, said boat cradle accepting the boat proximate to one end of said boat cradle;

said first movable lift member includes a first trolley mounted on said lift frame for sliding movement relative thereto solely along the docking direction, said flotation device being positioned on said first trolley so as to be disposed in the water when said lift frame is mounted to the dock;

said second movable lift member includes a second trolley mounted on said lift frame for sliding movement relative thereto solely along the docking direction; and said linkage moves said first trolley in response to movement of said second trolley by the boat to move said flotation device so that it exerts said upward force at a location along the docking direction between said attachment points and said one end of said boat cradle.

3. A boat lift as in claim 2, wherein said linkage is a mechanical linkage.

4. A boat lift as in claim 3, wherein said mechanical linkage comprises at least one cable attached to said first and second trolleys and having an intermediate portion between said trolleys, said intermediate portion passing over at least one pulley mounted to said lift frame.

5. A boat lift as in claim 4, wherein each said cable passes over two said pulleys to cause said first trolley to halve the distance travelled by said first trolley relative to the distance travelled by said second trolley.

6. A boat lift as in claim 2, wherein said lift frame has a generally rectangular planform with side rails on which said trolleys are mounted, said attachment points being located intermediate first and second ends of said side rails.

7. A boat lift as in claim 6 installed in the boat dock, wherein said lift frame rests in a boat receiving position with said boat cradle positioned relative to the water level for accepting the hull of the boat, the boat lift further comprising;

a releasable second trolley lock for securing said second trolley in a terminal position into which it has been moved by the boat after completion of a docking operation that moves the boat lift into a final docking position; and a releasable boat retainer moved into a boat retaining position by said first trolley for cooperating with the boat to retain the boat in place on said boat cradle when said second trolley is locked in said terminal position thereof.

8. A boat lift as in claim 7, wherein said dock cooperates with said lift frame in the final docking position to hold said lift frame relative to the water line in a position at which a force is exerted on said first trolley urging it in a direction opposite to the direction it traveled during the docking operation.

9. A boat lift as in claim 7, wherein:

said side rails are parallel to each other and extend along the docking direction, with said first end of said side rails being proximate to said one end of said boat cradle;

said lift frame has a boat receiving position in which said flotation device is disposed at a location on said side rails where it exerts an upward force on said lift frame intermediate of said attachment points and said second end of said side rails to position said one end of said boat cradle relative to the water level for accepting the boat;

said linkage moves said first trolley in a direction opposite to the direction the boat moves said second trolley during the docking operation; and when said second trolley reaches its terminal position, said flotation device is located on said side rails where it can exert said upward force intermediate of said attachment points and said first end of said side rails.

10. A boat lift as in claim 9, wherein said lift frame is maintained in said boat receiving position until the boat's propulsive power is terminated.

11. A boat lift as in claim 10, wherein said flotation device is shaped to exert a force on said boat lift in the presence of water flow induced by the propulsive power of the boat tending to maintain said boat lift in the rotated docking position.

12. A boat lift as in claim 11, wherein said boat lift further comprises a mechanism for assisting in maintaining said boat lift in the rotated docking position during the application of the boat's propulsive power.

13. A boat lift as in claim 1, further comprising a releasable second movable lift member lock for securing said second movable lift member in a terminal position into which it has been moved by the boat upon completion of a boat docking operation.

14. A boat lift as in claim 13, further comprising a boat retainer for cooperating with the boat to retain it in place on said boat cradle when said second movable lift member is locked in said terminal position.

15. A boat lift as in claim 1, wherein said boat cradle comprises a plurality of roller assemblies mounted on said lift frame.

16. A method of lifting a boat above a water level at which it normally floats, the method comprising;

providing a boat lift having a lift frame attached to a boat dock for rotation generally transverse to a direction the boat propels itself onto said boat lift, said frame including a boat cradle for accepting the boat, a first trolley mounted on said lift frame for sliding movement generally parallel to the direction the boat propels itself onto said boat lift, said first trolley including a flotation device disposed in the water for exerting on said frame an upward force sufficient to lift the boat above the water level at which it normally floats, a second trolley mounted on said lift frame for sliding movement when engaged by the boat as the boat propels itself onto said boat cradle, and a linkage between said first and second trolleys for moving said first trolley in a direction generally parallel and opposite to movement of said second trolley;

using the boat's propulsive power to propel the boat onto said boat cradle when said lift frame is rotated to a boat receiving position with said boat cradle positioned relative to the water level for accepting the hull of the boat;

continuing to apply the boat's propulsive power until said boat lift attains a rotated docking position with said second trolley moved to a terminal position by the boat and said lift frame remaining in said boat receiving position;

thereafter locking said second trolley in said terminal position and then terminating the boat's propulsive power thereby to allow said flotation device on said first trolley to move to a position in which the boat assumes a final docking position at a level above which it normally floats in the water; and actuating a boat retainer with said first trolley to hold the boat on said boat cradle in the final docking position.

17. A method as in claim 16, wherein said flotation device is shaped to exert a force on said boat lift in the presence of water flow induced by the propulsive power of the boat tending to maintain said boat lift in the rotated docking position.

18. A method as in claim 17, wherein said boat lift further comprises a mechanism for assisting in maintaining said boat lift in the rotated docking position during the application of the boat's propulsive power.

19. A method as in claim 18, wherein said mechanism comprises at least one damping mechanism for controlling the rate at which said lift frame rotates relative to said dock.

20. A method as in claim 16, wherein said dock cooperates with said lift frame in the final docking position to hold said lift frame relative to the water line in a position at which a force is exerted on said first trolley urging it in a direction opposite to the direction it traveled during the docking operation, the method further comprising the step of launching the boat by releasing said second trolley lock to permit said first trolley to move in the direction of the force so that said lift frame rotates toward the boat receiving position, wherein gravity urges the boat off of said boat cradle.

* * * * *